United States Patent [19]

Lindahl et al.

[11] 4,160,693

[45] Jul. 10, 1979

[54] PROCESS FOR THE BLEACHING OF CELLULOSE PULP

[75] Inventors: Jonas A. I. Lindahl, Domsjo; Ernst B. Tiberg, Ornskoldsvik; Sten L. Haggstrom, Overhornas, all of Sweden

[73] Assignee: Mo och Domsjo Aktiebolag, Ornskoldsvik, Sweden

[21] Appl. No.: 896,649

[22] Filed: Apr. 17, 1978

[30] Foreign Application Priority Data

Apr. 18, 1977 [SE] Sweden ..... 7704404

[51] Int. Cl.[2] ..... D21C 9/10; D21C 9/12; D21C 9/16; D21C 9/18

[52] U.S. Cl. ..... 162/24; 162/25; 162/29; 162/61; 162/65; 162/71; 162/78; 162/83; 162/87; 162/89

[58] Field of Search ..... 162/29, 61, 65, 78, 162/82, 87, 88, 89, 24, 25, 71

[56] References Cited

U.S. PATENT DOCUMENTS

| | | | |
|---|---|---|---|
| 1,642,978 | 9/1927 | Thorne | 162/65 |
| 3,186,899 | 6/1965 | Madison et al. | 162/24 |
| 4,029,543 | 6/1977 | Lindahl | 162/78 |

FOREIGN PATENT DOCUMENTS

| | | | |
|---|---|---|---|
| 2540919 | 4/1976 | Fed. Rep. of Germany | 162/24 |

*Primary Examiner*—S. Leon Bashore
*Assistant Examiner*—William F. Smith

[57] ABSTRACT

A process is provided for the bleaching of cellulose pulp, particularly for the peroxide bleaching of high yield pulp, which comprises forming a suspension of lignocellulosic pulp material; mixing the suspension in a mixing zone with a bleaching agent while adjusting the temperature of the pulp suspension to within the range from about +10° C. to about −10° C. of a temperature within the range from about 40° to about 95° C. at which bleaching is to be carried out; quickly dewatering the pulp suspension to a pulp consistency within the range from about 18 to about 50%, equal to or at most 5% less than the pulp consistency of the pulp suspension charged to the mixing zone; passing the dewatered pulp suspension to the bleaching zone before its temperature can change substantially from the adjusted temperature; carrying out the bleaching with a bleaching agent at the selected bleaching temperature within the range from about 40 to about 95° C.; and recycling the bleaching liquor recovered from the dewatering to the mixing zone while maintaining a temperature in the recycled liquor to bring the pulp suspension to within said range of the bleaching temperature during the mixing with bleaching agent.

12 Claims, 1 Drawing Figure

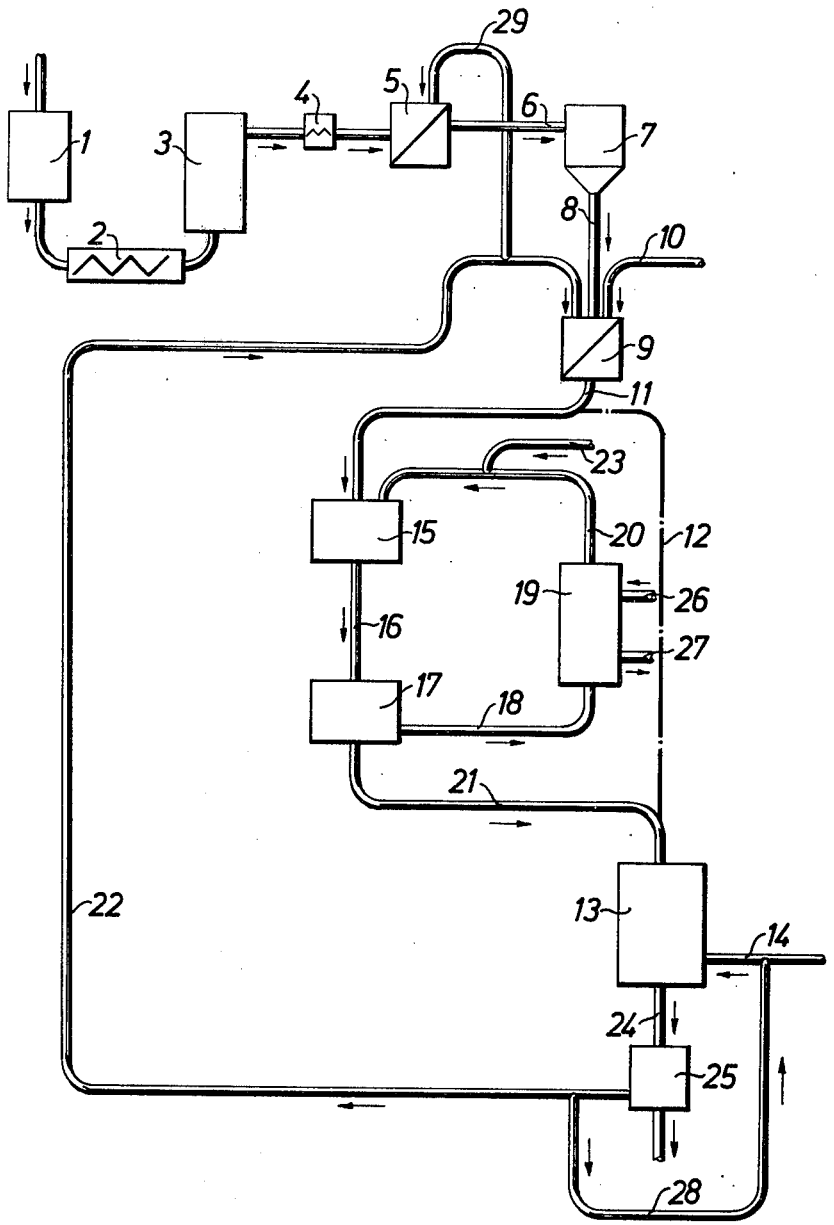
29
5
4
6
1
3
7
8
2
10
9
11
23
15
20
12
19
26
16
27
17
18
21
22
13
14
24
25
28

PROCESS FOR THE BLEACHING OF CELLULOSE PULP

Cellulose pulps having a high lignin content are referred to as "high-yield pulps," and this class of pulps includes groundwood pulps, chip-refined pulps, thermomechanical pulps, chemimechanical pulps, and semimechanical pulps. A feature in common to all of these cellulose pulps is that the fibers of the lignocellulosic material are freed at least in part mechanically and optionally also in part chemically. The mechanical defibration is effected in a grinder, a disc refiner or a screw defibrating apparatus of the type sold under the name FROTAPULPER®, in which the pulp is subjected to a mild mechanical shearing force without appreciably lowering its resistance to dewatering. The mechanical defibration step is an essential step; high-yield pulp can only be prepared either exclusively by mechanical defibration, or by a combination of mechanical defibration and chemical pulping steps.

It is possible using known techniques to bleach high-yield pulps to a brightness of 80% or higher in accordance with SCAN C-11:62. However, the cost of bleaching chemicals is very high in relation to the brightness obtained in comparison with other pulps, such as chemical pulps. A further problem is that the temperature during the bleaching operation varies considerably with variations in temperature in the preceding stages of the pulp manufacturing process. Thus, the temperature of the pulp entering the bleaching zone can vary from 50° to 70° C., depending upon the temperature conditions in the preceding steps, as well as variations in the temperature of the water supplied to the process.

The bleaching of high-yield pulps is normally carried out by one of two processes, referred to generally as "refiner bleaching" and "tower bleaching." In refiner bleaching, the bleaching chemicals are added to the lignocellulosic material upstream of the defibration stage, i.e., the refiner, or are charged directly to the defibration stage, i.e., the refiner, and bleaching begins in the course of the defibration on partially defibrated lignocellulosic material. In tower bleaching, the bleaching is effected on fully defibrated lignocellulosic material, in a separate zone, such as a bleaching tower. Combinations of these bleaching methods can also be used, in sequence.

Refiner bleaching is principally used in the manufacture of chip-refiner pulp and thermomechanical pulp, the pulp being defibrated in two stages, and the bleaching chemicals being added immediately before or during the second defibration stage. In this case, the temperature during defibration, i.e., in the refiner, is normally relatively high, frequently 100° C. or higher. As a result of the high temperature, a considerable proportion of the bleaching agent decomposes. For example, hydrogen peroxide, particularly in admixture with alkali, rapidly decomposes at temperatures of 70° C. and above. At such temperatures, a part of the bleaching agent can also be volatilized, and escapes with the steam generated by the heat generated by mechanical attrition and friction and liberated during defibration. As a result of this, large quantities of the bleaching agent charged to the process are lost and wasted, and, probably in part due to this, the brightness obtained in refiner bleaching is not as a rule higher than 75% SCAN.

In tower bleaching, in a separate bleaching zone, as in a tower, the pulp usually is continuously flowed through the tower, entering at one end and leaving at another end, and the pulp is normally screened upstream of the bleaching zone to remove shives and impurities at a relatively low pulp consistency, normally less than 1%. Consequently, the pulp is diluted, and must be reconcentrated or dewatered prior to bleaching, in order to reduce the cost of the bleaching chemicals added, since their effectiveness is a function of their concentration in the pulp suspension. Best bleaching results in peroxide bleaching are obtained at relatively high pulp consistencies, and therefore the pulp is normally dewatered on drum filters to a maximum pulp consistency of about 20%. In comparison with refiner bleaching, tower bleaching has the advantage of lower chemical cost, but the disadvantage of considerably higher plant costs, because of the bleaching installations required.

Swedish Pat. No. 149,703 suggests that the amount of peroxide consumed in tower bleaching processes can be reduced by dividing the bleaching reactions into two stages, the first stage being effected at a relatively low pulp consistency, of the order of from 2 to 6%, for a relatively long period of time (approximately two hours). Excess peroxide bleaching liquor in the first stage is withdrawn when the pulp has reached a maximum brightness, and the bleaching is then continued in a second stage, with a lower concentration of peroxide in the liquor, but at double the pulp consistency. The disadvantage of this approach, however, is that the low consistency of the pulp in the first stage requires an oversize bleaching tower, and the bleaching efficiency is much lower at low pulp consistencies than with high pulp consistencies, because of the dilution. Moreover, two bleaching towers must be used for the two stages, when the bleaching is to be carried out as a continuous flow process.

The process of the present invention makes it possible to reduce the cost of bleaching chemicals in tower bleaching, as well as in refiner bleaching in combination with tower bleaching, while improving the heat economy.

In accordance with the present invention, a method for the bleaching of lignocellulosic material or cellulose pulp is provided which includes the steps of forming a pulp suspension of lignocellulosic material having a pulo consistency within the range from about 18 to about 55%, mixing the material with a bleaching agent in a mixing zone and forming a pulp suspension having a pulp consistency within the range from about 2% to about 15%, and then bleaching at a temperature within the range from about 40° to about 95° C., desirably in a continuous flow through a bleaching zone. The bleaching stage of the invention is analogous to tower bleaching, and features the steps of bringing the pulp suspension to a temperature that is within the range from about +10° C. to about −10° C. of the bleaching temperature range from about 40° C. to about 95° C. during the mixing with bleaching agent; before introducing the pulp suspension into the bleaching zone, quickly dewatering the pulp suspension to a pulp consistency within the range from about 18% to about 50% that is substantially equal to or at most 5% less than the pulp consistency of the pulp suspension charged to the mixing zone; passing the dewatered pulp suspension to the bleaching zone before its temperature can change substantially from the said temperature range, and carrying out the bleaching at a temperature within the range from about 40° to about 95° C.; recycling the liquor containing bleaching agent recovered from the dewatering to the mixing zone, while maintaining a temperature in the recycled liquor to bring the pulp suspension to within the said range of the bleaching temperature in the course of the mixing with bleaching agent. It is normally desirable that the mixing and dewatering steps be carried out so rapidly that a total of less than 300 seconds has elapsed by the time the pulp suspension is dewatered.

Preferably, the pulp suspension during the mixing is brought to a temperature that is substantially the same as the bleaching temperature in the bleaching zone.

Optimum results in accordance with the invention are obtained when the pulp consistency in the mixing zone is within the range from about 8 to about 12%, and the pulp suspension after mixing with bleaching agent is dewatered to a pulp consistency within the range from about 20 to about 32%.

The process of the invention can be applied directly after a hot defibration stage, such as a refining stage, without decomposition of the peroxide bleaching agent combined with the pulp suspension in the mixing zone.

Despite the high temperature of the pulp suspension entering the mixing zone, the process makes it possible to reach a high degree of brightness at a low consumption of bleaching agent. This is quite surprising, since it is generally accepted that the chemical bleaching of pulp directly following treatment in a disc refiner results in a high bleaching chemical consumption.

In the process of the invention, any bleaching agent can be used. The preferred bleaching agent is a peroxide bleaching agent, such as hydrogen peroxide, sodium peroxide, and peracetic acid; other peroxide bleaching agents such as performic acid, perpropionic acid, and barium peroxide can be used. Hydrogen peroxide is particularly suitable. Additional peroxide bleaching chemicals can be added, such as stabilizers and pH modifiers, for example, sulfuric acid, sodium hydroxide, sodium silicate, sodium phosphate, and magnesium sulfate.

Other types of oxidizing bleaching agents can be used, such as chlorine, chlorine dioxide and hypochlorite, oxygen and alkali, as well as reducing bleaching agents such as sodium dithionite (sodium hydrosulfite), zinc dithionite, sodium borohydride, hydroxylamine and thioglycolic acid.

In a preferred embodiment of the invention, screened defibrated cellulose pulp is dewatered to a pulp consistency within the range from about 18 to about 50%, and preferably from about 20 to about 32%. The pulp suspension is then mixed with cooled or heated recirculated peroxide bleaching liquor (from the dewatering before the bleaching zone) and a minor quantity of fresh peroxide bleaching agent in a mixing zone to a pulp consistency within the range from about 2 to about 15%, and preferably from about 8 to about 12%. The total of fresh bleaching chemicals added is at most 60% of the total bleaching chemical requirement. The remainder of the bleaching chemicals requirement is met by the chemicals present in the recirculating peroxide bleaching liquor from the dewatering.

If the pulp suspension charged to the mixing zone is above the selected bleaching temperature, the recycled peroxide bleaching liquor from the dewatering is cooled in a heat exchanger to a temperature within the range from about 5° to about 50° C. and preferably from about 25° to about 40° C. If the entering pulp suspension is below the selected bleaching temperature, the recycled peroxide bleaching liquor is heated to a temperature within the range from about 55° to about 99° C., and preferably from about 60° to about 90° C. The temperature of the recycled peroxide bleaching liquor is so regulated that the temperature of the pulp suspension and bleaching chemical mixture in the mixing zone is within the range from about 40° to about 95° C., and preferably from about 50° to about 65° C., and within the range from about +10° C. to about −10° C. of the selected bleaching temperature within this range. The mixture of pulp suspension and bleaching chemicals is thoroughly mixed in a suitable mixer, such as a disc refiner or a screw defibrator, or conventional mixing equipment using a propeller or other type of agitator. The mixing is gentle, so as to minimize the generation of heat during mixing, and limit any rise in temperature of the suspension in the course of passage through the mixing zone of at most 3° C.

The resulting pulp suspension is dewatered to a consistency which is either the same as or at most 5%, preferably at most 3%, less than the consistency of the pulp entering the mixing zone. The dewatered pulp suspension is then brought to the bleaching zone, where it is bleached at the selected bleaching temperature within the range from about 40° to about 95° C. for a suitable time, normally from about fifteen minutes to about three hours, and preferably for from one to two hours. The peroxide bleaching liquor recovered in the dewatering is recycled to the mixing zone, after being cooled or heated.

The steps of mixing the pulp suspension with bleaching chemicals and dewatering should be carried out as quickly as possible, before the temperature of the pulp suspension can change to outside the stated range in the mixing zone. Normally, the total elapsed total time is less than 300 seconds, i.e., five minutes, and is preferably less than 50 seconds, i.e., less than about one minute.

The bleached pulp from the bleaching zone can then be dried or passed directly to a paper-making machine. If the pulp is bleached in a continuous process, for example, passing continuously through a tower bleaching zone from the top to the bottom of the zone, the pulp is normally diluted with water at the bottom of the zone, in order to render the pulp pumpable. The pulp suspension can then be pumped to a press for removing the residual bleaching chemicals in the form of a solution thereof in spent bleaching liquor, and this can be returned in whole or in part to a mechanical defibration stage, optionally after first having been cooled. A minor part of the spent bleaching liquor recovered from the press can also be recycled to the mixing zone, for the dilution of and blending with fresh bleaching chemicals, thus substituting all or part of the fresh water needed for this purpose.

Alternatively, the pulp from the first bleaching stage can be further bleached in a second bleaching stage, which can utilize a peroxide bleaching agent or another oxidizing bleaching agent, or a reducing bleaching agent. Suitable reducing bleaching agents include sodium dithionite, zinc dithionite, sodium borohydride, hydroxylamine and thioglycolic acid. If a reducing bleaching agent is used in the second bleaching stage after a first peroxide bleaching stage, it is suitable to treat the pulp with sulfur dioxide and sulfuric acid before the second bleaching stage, in order to reduce the pH of the partially bleached pulp suspension, and neutralize peroxide residues.

Subsequent to defibration, the pulp charged to the mixing zone normally has a consistency within the range from about 20 to about 35%, and a temperature of approximately 90° C. Before charging to the mixing zone, this pulp may optionally be diluted with water or waste peroxide bleaching liquor, screened and reconcentrated by a press.

The bleaching chemicals added to the pulp suspension in the mixing zone to replenish the loss in bleaching chemicals during mixing and dewatering can be fresh chemicals or chemicals originating from recycled bleaching liquors.

The quantities of pulp charged in the mixing zone and of recirculated bleaching agent liquor from the dewatering charged to the mixing zone should be maintained constant, in order to maintain a constant pulp consistency in the pulp suspension entering the bleaching zone. The mixing of the pulp suspension with the bleaching agent can be carried out advantageously in a mixing apparatus which subjects the material to a mild mechanical shearing force at the same time. A suitable apparatus is a high consistency refiner, or a screw defibrator of the type sold under the name FROTAPULPER®.

The process of the invention is applicable both to batch bleaching processes and to continuous bleaching processes in which the pulp suspension is passed continuously into the bleaching zone at one end and withdrawn from the bleaching zone at the other end. In this event, the mixing zone and the dewatering zone are also continuous zones, in which the pulp suspension enters at one end, and is withdrawn after completion of the mixing and/or dewatering at the other end of the zone.

The process of the invention is applicable to all types of pulps, though particularly to high-yield pulps, including groundwood pulps, chip-refined pulps, thermomechanical pulps, chemimechanical pulps and semimechanical pulps, in all of which processes at least one stage of the defibration is a mechanical defibration stage, using for example, a grinder, disc refiner, or screw defibrator apparatus, such as a FROTAPULPER®.

The process is also applicable to chemical pulps, such as sulfite pulps, sulfate pulps, soda pulps, and oxygen-/alkali pulps.

When applied for the bleaching of unscreened or screened chemical pulps, the process of the invention is especially applicable to such bleaching and alkali extraction stages which conventionally are performed at high pulp consistencies. The bleaching stage may in this case also be a hypochlorite stage.

The pulps can be obtained from any type of lignocellulosic material, including softwoods, such as pine, spruce, juniper, redwood, cedar, hemlock, larch and fir, and hardwoods, including beech, birch, poplar, gum, oak, maple, sycamore, olive, eucalyptus, aspen, cottonwood, bay, hickory and walnut.

The following Examples in the opinion of the inventors represent preferred embodiments of the invention.

EXAMPLE 1

A portion of screened thermomechanical spruce pulp having a brightness of 59% SCAN and a Canadian Standard Freeness of 125 ml, designated as sample A, and a portion of screened stone-ground groundwood pulp derived from spruce, having a brightness of 62% SCAN and a Canadian Standard Freeness of 90 ml, designated as sample B, were pretreated with 0.2% aqueous diethylenetriamine pentaacetic acid (DTPA) solution, and dewatered to a pulp consistency of 30%. The samples were then mixed with water and peroxide bleaching chemicals to produce a pulp suspension ready for bleaching and having a consistency of 12%. The amounts of bleaching chemicals charged, calculated on an absolute dry pulp basis, were as follows:

TABLE I 8.0% $H_2O_2$ (calculated as 100% $H_2O_2$)
15.0% $Na_2SiO_3$ of 40° Bé (commercial grade)
3.5% NaOH (calculated as 100% NaOH)
0.03% $MgSO_4.7H_2O$ (calculated as Mg).

After mixing the chemicals with the pulp suspension for thirty seconds, the pulp suspensions were dewatered to a pulp consistency of 26%. The filtrate recovered from the dewatering contained 20.5 g/l sodium silicate and 10.2 g/l hydrogen peroxide.

The pulp samples were then placed in a glass jar, which was heated in a water bath at 60° C. for sixty minutes to effect the bleaching.

The dewatered sample A at 26% pulp consistency should theoretically contain the following quantities of chemicals, calculated on an absolute dry pulp basis:

TABLE II 3.11% $H_2O_2$
5.83% $Na_2SiO_3$, 40° Bé
1.36% NaOH
0.011% $MgSO_4.7H_2O$

The filtrate should have contained 10.9 g/l of hydrogen peroxide. Since the hydrogen peroxide content was only 10.2 g/l, 0.7 g of hydrogen peroxide per liter had already been consumed, corresponding to 0.51% based on the weight of the absolutely dry pulp. Subsequent to the dewatering of the pulp from a 12 to a 26% pulp consistency, the pulp thus contained 2.97% hydrogen peroxide, and not the theoretically calculated 3.11%. The amount of hydrogen peroxide required for the bleaching of sample A can thus be seen to be 3.48%, i.e., the sum of 0.51% consumed during the mixing process and 2.97%, the actual quantity of hydrogen peroxide left in the sample subsequent to the dewatering. In the case of Sample B, the amount of hydrogen peroxide required for the bleaching can be said to be 3.48%, i.e., the sum of 0.51% consumed during the mixing process and 2.97%, the actual quantity of hydrogen peroxide left in the sample subsequent to the dewatering.

The filtrates obtained in dewatering samples A and B were used for mixing in and bleaching of an additional sample of thermomechanical spruce pulp, designated sample A1, and a groundwood pulp, designated sample B1. A further three samples designated A2, A3 and A4, and B2, B3 and B4, of each type of pulp were bleached in the same manner. To compensate for the chemicals which were consumed and which accompanied the dewatered pulp samples, the following quantities of fresh chemcials, calculated on the basis of absolutely dry pulp, were charged to each of the samples A1, A2, A3, A4, and B1, B2, B3 and B4:

TABLE III 3.48% $H_2O_2$ (calculated as 100% $H_2O_2$)

1.50% NaOH (calculated as 100% NaOH)
6.00% $Na_5SiO_3$, 40° Bé (commercial grade)
0.01% $MgSO_4.7H_2O$ (calculated as Mg).

Taking into account the chemicals recycled in the filtrate from the dewatering of the respective samples, each sample received a total charge of bleaching chemicals of 8% hydrogen peroxide and 15% sodium silicate, the same quantities as were mixed with samples A and B, respectively, at a pulp consistency of 12%. In order to adjust pH to the same pH for samples A1, A2, A3, A4, respectively, and samples B1, B2, B3 and B4, respectively, it was necessary in addition to charge 1.5% sodium hydroxide, and, in order to compensate for the loss of magnesium sulfate (which accompanied the pulp when being dewatered from the consistency of 12% to a consistency of 26%), 0.011% magnesium was added in the form of $MgSO_4.7H_2O$.

The amount of chemicals charged to samples A1, A2, A3, A4 and B1, B2, B3 and B4, respectively, subsequent to dewatering the pulp from a consistency of 12% to a consistency of 26%, is equivalent to the amount of fresh chemicals charged, as shown in Table III.

After bleaching the pulps at a consistency of 26% for sixty minutes at 60° C., all of the samples were diluted with distilled water to a pulp consistency of 4%, dewatered to a pulp consistency of 30%, shredded into small pieces, and dried at 35° C. for sixteen hours.

For purposes of comparison, samples taken from the same thermomechanical spruce pulp and groundwood spruce pulp were then bleached in accordance with known techniques. These samples were also pretreated with 0.2% aqueous DTPA solution prior to being bleached. The samples were dewatered to a pulp consistency of 30%, after which peroxide bleaching chemicals were mixed in the pulp, and the pulp consistency became 26%. The quantities of bleaching chemicals charged, calculated on the absolutely dry pulp, were as follows:

TABLE IV 4.1% $H_2O_2$ (calculated as 100% $H_2O_2$)
1.5% NaOH (calculated as 100% NaOH)
6.0% $Na_2SiO_3$, 40° Bé (commercial grade)
0.012% $MgSO_4.7H_2O$ (calculated as Mg).

The samples were bleached at 60° C. for sixty minutes and then treated in the same manner as samples A1, A2, A3, A4, B1, B2, B3 and B4, after which the SCAN brightness of all the samples was determined. The results obtained are shown below:

TABLE V

| | Brightness SCAN %[1] | |
|---|---|---|
| | Example 1 | control |
| Thermomechanical pump: | | |
| Sample A | 79.6 | 77.6 |
| A1 | 79.7 | |
| A2 | 79.4 | |
| A3 | 79.5 | |
| A4 | 79.7 | |
| Groundwood pulp: | | |
| Sample B | 83.1 | 80.8 |
| B1 | 82.8 | |
| B2 | 82.6 | |
| B3 | 82.9 | |
| B4 | 82.8 | |

[1]SCAN C11:62

Although the amount of peroxide bleaching agent charged was less, the pulps bleached in accordance with the invention had a brightness which was approximately two units higher than that obtained with the control, using hydrogen peroxide in accordance with the known technique. Approximately 1% more hydrogen peroxide, calculated on the absolutely dry pulp, is required to obtain the same brightness in peroxide bleaching in accordance with the known technique, than in peroxide bleaching in accordance with the invention. In practice, this means a reduction in chemicals cost of from $7.50 to $12.00 per ton of pulp, using the process in accordance with the invention.

EXAMPLE 2

In this Example, the pulp was bleached in a plant whose layout is shown schematically in the flow diagram of the FIGURE, used for the manufacture of thermomechanical pulp from spruce wood.

This plant is normally operated as follows: Spruce logs are reduced to spruce chips, which are then blown into a steaming vessel 1, by way of an ejector (which is not shown). The chips are treated with saturated steam in the vessel 1 for ten minutes at atmospheric pressure. After steaming, the chips are conveyed by the screw feeder 2 to the pressure vessel 3, where the chips are heated with saturated steam at 120° C. for two minutes. The heated chips are then fed by the screw feeder 4 to the single disc defibrator 5, whose disc diameter is 1050 mm. The resulting pulp is then blown at a consistency of 34% and a temperature of 110° C. through the conduit 6 from the grinding housing of the defibrator to the cyclone 7, for steam separation. The pulp then is passed from the cyclone 7 to a second defibration stage by way of the disc refiner 9 via the conduit 8. The temperature of the pulp fed to the second disc refiner is 89° C. Thermoelements are mounted in the grinding segments of the disc refiner, so that the temperature between the grinding discs can be read off. The temperature ranges between 115° C. and 125° C. in the course of the runs.

At the same time, an aqueous solution of bleaching chemicals containing 4% hydrogen peroxide, 8% $Na_2S_2O_3$, 1.5% NaOH, 0.02% $MgSO_4.7H_2O$, and 0.2% diethylenetriamine pentaacetic acid, calculated on the absolutely dry pulp, was charged to the refiner. The bleaching chemical solution is charged through a conduit 10 to the disc refiner 9 in a volume such that the consistency leaving the refiner through the conduit 11 is 30%, while its temperature is 90° C.

The outgoing pulp is passed to a bleaching tower 13 through a conduit 12 (shown in dashed lines in the FIGURE). Pulp samples are taken partly from the disc refiner 9 directly, before any bleaching and after bleaching times of fifteen, thirty, forty-five and sixty minutes, respectively, in the bleaching tower 13. Subsequent to being washed, the pulp is dried for sixteen hours at 35° C., after which its brightness is determined. During the sixty-minutes period of the run, the temperature of the pulp in the bleaching tower drops from 90° C. to 83° C.

The pulp is diluted in the lower part of the bleaching tower to a consistency of 4% using water via conduit 14 and waste bleaching liquor via conduit 28. The diluted pulp is passed to a screw press 25 via line 24, in which press the pulp is dewatered to a consistency of 50%.

This normal procedure was modified as follows in the runs using the process of the invention: The pulp leaving the disc refiner 9 via conduit 11 was passed to the mixer 15, in which it was mixed with recirculated peroxide bleaching liquor from the dewatering stage 17, and cooled in the heat exchanger 19° to 45° C. for ten seconds. The perioxide bleaching liquor was recirculated through the conduit 20, and was composed partly of bleaching chemical solution obtained when dewatering the pulp in the screw press 17, and partly of fresh bleaching chemicals, added to the liquor via the conduit 23.

Subsequent to mixing the pulp with the bleaching liquor, the pulp had a pulp consistency of 10% and a temperature of 60° C. The pulp was then passed via conduit 16 to the screw press 17, in which it was dewatered over a period of eight seconds from the consistency of 10% to a consistency of 30%. The outgoing pulp had a temperature of 62° C., and was passed via conduit 21 to the bleaching tower 13, in which the temperature was maintained at 60° C. After sixty minutes in the bleaching tower, the pulp was diluted to a consistency of 4%, partly with water via conduit 14 and partly with back water from the press 25, containing residues of bleaching chemicals. The diluted pulp suspension was passed via conduit 24 to the press 25, in which it was dewatered to a 40% pulp consistency. Subsequent to being dewatered, samples were taken, washed and dried at 35° C. for sixteen hours, and the SCAN brightness then determined. The waste bleaching liquor obtained from the press 25 was analyzed to determine its content of hydrogen peroxide and sodium silicate, with the following results:

0.50 g/l $H_2O_2$ (calculated as 100% $H_2O_2$)
3.20 g/l $Na_2SiO_3$, 40° Bé (commercial grade).

The pH of the liquor was 8.3.

The major part of this waste bleaching liquor was returned via the conduit 28 to the lower portion of the bleaching tower, while approximately 2 cubic meters of waste bleaching liquor per ton of pulp was passed partly to the disc refiner 9 and partly to the disc refiner 5 via conduits 22 and 29, respectively. In this way, a total of 0.1% hydrogen peroxide and 0.6% sodium silicate was passed to the two refining stages. No water was passed through the conduit 10 to the refiner 9 in the course of this mode of operation.

The bleaching liquor obtained from the screw press 17 had the following composition:

TABLE VI 16.0 g/l $H_2O_2$
34.4 g/l $Na_2SiO_3$, 40° Bé
0.08 g/l $MgSO_4.7H_2O$
pH 9.6.

This bleaching liquor was passed via conduit 18 through a cooler 19, the cooling water entering via conduit 26 having a temperature of 8° C., and the cooling water leaving via conduit 27 having a temperature of 42° C.

Fresh bleaching chemicals were passed via conduit 23 to conduit 20, where they were mixed with the cooled bleaching liquor. The amounts of bleaching chemicals charged, calculated on absolutely dry pulp, were as follows:

TABLE VII 4.0% $H_2O_2$ (calculated as 100% $H_2O_2$)
1.1% NaOH (calculated as 100% NaOH)
2.3% $Na_2SiO_3$, 40° Bé (commercial grade)
0.01% $MgSO_4.7H_2O$ (calculated as Mg).

These fresh chemicals together with bleaching liquor were passed via conduit 20 to the mixer 15, and the pulp was then passed to the press 17 via conduit 16, and to the bleaching tower 13 via conduit 21.

Eleven samples of the pulp were taken from the screw press 25, and their SCAN brightness determined with the following results:

TABLE VIII

| | Brightness, SCAN %[1] |
|---|---|
| Control 1 | |
| Conventional refiner bleaching | 73.0 |
| Control 2 | |
| Conventional refiner bleaching | |
| + after bleaching in tower 15 minutes | 73.7 |
| + after bleaching in tower 30 minutes | 73.2 |
| + after bleaching in tower 45 minutes | 72.7 |
| + after bleaching in tower 60 minutes | 72.4 |
| Example 2 | |
| Bleaching in accordance with the invention (mean value of the eleven samples) | 76.8 |

[1]SCAN C11:62

It is apparent from these results that the process of the invention gives a bleached pulp having a much higher brightness than the control pulps obtained from a conventional refiner bleaching process. The result is surprising, in view of the fact that the pulp was not screened, nor treated with complexing agents prior to the bleaching.

These favorable results cannot at present be explained. It is however possible that the admixing of bleaching chemicals is particularly effective at a low pulp consistency, and that bleaching at a high pulp consistency also contributes to the exceptionally good bleaching effect.

EXAMPLE 3

A portion of screened spruce sulfite pulp, Example 3, Sample A, having a brightness SCAN of 63%, an extractives content of 0.43% dkm (SCAN-C7:62) and a viscosity of 1163 $m^3/g$ was mixed with sodium hypochlorite and water to produce a pulp suspension having a consistency of 10%. The amount of chemicals charged, calculated on an absolutely dry pulp basis, was as follows:

NaOCl: 3.0% (calculated as active chlorine)
NaOH: 2.0% (calculated as 100% NaOH)

After mixing the chemicals with the pulp suspension for 28 seconds, the pulp suspension was dewatered to a pulp consistency of 27%. The filtrate contained an amount of NaOCl corresponding to an active chlorine content of 3.00 g/l, and the pH was 11.2.

The dewatered pulp was then placed in a glass jar, which was heated in a water bath at 50° C. for 120 minutes, to effect the bleaching. After dewatering to 27% pulp consistency, the pulp sample theoretically should have contained 0.88% NaOCl, calculated as active chlorine. Consequently, the filtrate should have contained 3.22 g active chlorine/l. Since the active chlorine content of the filtrate was only 3.00 g/l, apparently 0.22 g/l of active chlorine had already been consumed, in spite of the rapid mixing. 0.22 g/l of active chlorine corresponds to 0.20% chlorine, when calculated on an absolutely dry pulp basis.

Subsequent to the dewatering to a 27% pulp consistency, the pulp contained 0.81% NaOCl calculated as active chlorine, and not the theoretically calculated 0.88% chlorine. The amount of NaOCl required for the bleaching of the pulp Sample A can thus be seen to be 1.01%, i.e., the sum of 0.020% consumed during the mixing process, and 0.81%, the actual quantity left in the sample subsequent to the dewatering.

As a control, showing application of a conventional bleaching, another portion of the same spruce sulfite pulp, Sample B, was mixed with NaOCl, NaOH and $H_2O$, producing a pulp suspension having a 50% pulp consistency. The amount of chemicals charged, calculated on an absolutely dry pulp basis, was as follows:
NaOCT: 1.0% (calculated as active chlorine)
NaOH: 0.80% (calculated as 100% NaOH)

The pulp, Sample B, was then placed in a glass jar, which was heated in a water bath at 50° C. for 120 minutes to effect the bleaching.

Subsequent to the bleaching for 120 minutes, Samples A and B were diluted with water to a pulp consistency of 3%. The diluted Samples A and B were then dewatered to a pulp consistency of about 30%. The dilution and dewatering of the samples was repeated twice, so that an efficient washing of each sample was obtained. The washed pulp samples were then torn to small pieces, and dried to a solids content of 92%. The dry pulp Samples A and B were tested for brightness, extractive content and viscosity. The test results are shown in Table IX.

TABLE IX

| | Brightness[1] % | Extractives content[2] (dkm%) | Viscosity[3] ($cm^3/g$) |
|---|---|---|---|
| Example 3 (Sample A) | 83.4 | 0.36 | 1082 |
| Control (Sample B) | 79.2 | 0.38 | 1059 |

[1]SCAN C11:63
[2]SCAN C7:62
[3]SCAN C15:62

From the test results, it is clearly apparent that the process of the invention when applied to chemical pulp gives a bleached pulp having a much higher brightness than the control pulp, Sample B, bleached in a conventional bleaching process. In addition, it is surprising that the viscosity of the pulp Sample A, bleached according to the process of the invention, is higher than that of the control Sample B, particularly in view of the fact that the pulp Sample A was bleached at a considerably higher pulp consistency. Normally, when using conventional bleaching techniques, an increase in the pulp consistency results in a reduced viscosity in the bleached pulp.

Having regard to the foregoing disclosure, the following is claimed as the inventive and patentable embodiments thereof:

1. A process for the bleaching of lignocellulosic material, which comprises forming a pulp suspension of lignocellulosic material having a consistency within the range from about 18% to about 55%; mixing the suspension in a mixing zone with a bleaching agent while adjusting the consistency of the pulp suspension to within the range from about 2% to about 15% and the temperature of the pulp suspension to within the range from about +10° C. to about −10° C. of a temperature within the range from about 40° to about 95° C. at which bleaching is to be carried out; quickly dewatering the pulp suspension to a pulp consistency within the range from about 18 to about 50%, equal to or at most 5% less than the initial pulp consistency of the pulp suspension charged to the mixing zone; passing the dewatered pulp suspension to the bleaching zone before its temperature can change substantially from the adjusted temperature; carrying out the bleaching with a bleaching agent at the selected bleaching temperature within the range from about 40° to about 95° C.; and recycling the bleaching liquor recovered from the dewatering to the mixing zone while maintaining a temperature in the recycled liquor to bring the pulp suspension to within said range of the bleaching temperature during the mixing with bleaching agent.

2. A process according to claim 1 in which the lignocellulosic material is a high-yield cellulose pulp and the bleaching agent is a peroxide bleaching agent.

3. A process according to claims 1 or 2, in which the temperature of the dewatered pulp suspension entering the bleaching zone is within the range from about +3° C. to about −3° C. of the bleaching temperature applied in the bleaching zone.

4. A process according to claims 1 or 2, in which the bleaching agent comprises in part bleaching liquor from the dewatering and in part added fresh bleaching agent.

5. A process according to claims 1 or 2, in which the mixing and dewatering steps are carried out within a total elapsed time of 300 seconds.

6. A process according to claims 1 or 2, in which the mixing and dewatering steps are carried out within a total elapsed time of 50 seconds.

7. A process according to claims 1 or 2, in which the quantity of pulp suspension added to the mixing zone and the volume of recycled bleaching liquor added to the mixing zone are adjusted to maintain a constant pulp consistency in the pulp suspension entering the bleaching zone.

8. A process according to claims 1 or 2, in which the lignocellulosic material while being mixed with bleaching agent is subjected to a mild mechanical shearing force without appreciably impairing dewaterability of the pulp suspension.

9. A process according to claims 1 or 2, in which the mixing, dewatering, bleaching and recycling of liquor from the dewatering are carried out in a continuous flow system, in the stated zone sequence, the pulp suspension entering each zone at one end and leaving the zone at the other end of each zone.

10. A process according to claims 1 or 2 in which the pulp from the bleaching stage is further bleached in a second bleaching stage, utilizing in each stage a bleaching agent selected from the group consisting of oxidizing bleaching agents and reducing bleaching agents.

11. A process according to claim 10 in which the bleaching agent in the first stage is a peroxide bleaching agent.

12. A process according to claims 1 or 2, in which bleaching liquor from the dewatering is cooled to a temperature within the range from about 5° to about 50° C. and added to the pulp suspension in the mixing zone at such a rate that the temperature of the pulp suspension and bleaching agent in the mixing zone is maintained within the range from about 40° to about 75° C., and within the range from about +10° C. to about −10° C. of the selected bleaching temperature within this range.

* * * * *